US007591734B2

(12) United States Patent
Mazzone

(10) Patent No.: US 7,591,734 B2
(45) Date of Patent: Sep. 22, 2009

(54) GOLF SWING AID

(75) Inventor: Jeff Mazzone, 227 Alexander Ave., Scotia, NY (US) 12302

(73) Assignee: Jeff Mazzone, Scotia, NY (US)

( * ) Notice: Subject to any disclaimer, the term of this patent is extended or adjusted under 35 U.S.C. 154(b) by 0 days.

(21) Appl. No.: 12/151,240

(22) Filed: May 5, 2008

(65) Prior Publication Data

US 2008/0274821 A1 Nov. 6, 2008

Related U.S. Application Data

(60) Provisional application No. 60/927,487, filed on May 3, 2007.

(51) Int. Cl.
*A63B 69/36* (2006.01)

(52) U.S. Cl. ..... 473/277; 473/257

(58) Field of Classification Search ..... 473/218, 473/219, 257, 266, 268, 269–277
See application file for complete search history.

(56) References Cited

U.S. PATENT DOCUMENTS

| | | | | |
|---|---|---|---|---|
| 1,936,143 | A | 11/1933 | Shea | |
| 3,215,438 | A | 11/1965 | Sheldon et al. | |
| 3,698,721 | A | 10/1972 | Stewart | |
| 4,659,084 | A * | 4/1987 | Vuick | 473/264 |
| 5,288,074 | A | 2/1994 | Scheurer | |
| 5,303,926 | A * | 4/1994 | Owens et al. | 473/261 |
| 5,433,445 | A * | 7/1995 | Melancon | 473/261 |
| 5,591,090 | A | 1/1997 | Kauffman, Jr. | |
| 5,762,565 | A | 6/1998 | Milam et al. | |
| 5,830,079 | A | 11/1998 | Hudson | |
| 6,497,627 | B2 * | 12/2002 | Collins | 473/264 |
| 6,575,844 | B1 * | 6/2003 | Gray | 473/277 |
| 6,843,730 | B1 * | 1/2005 | Bellagamba | 473/216 |
| 6,988,957 | B2 * | 1/2006 | Bender | 473/266 |
| 7,431,661 | B1 * | 10/2008 | Cailey | 473/257 |
| 2005/0159234 | A1 | 7/2005 | Lee et al. | |

* cited by examiner

*Primary Examiner*—Nini Legesse
(74) *Attorney, Agent, or Firm*—Buchanan Ingersoll & Rooney PC

(57) ABSTRACT

A golf swing aid is disclosed that includes a base, an elongated member and at least one generally L-shaped member. The one or more generally L-shaped members are moveably connected to the elongated member such that the one or more generally L-shaped members are positionable vertically along at least a portion of the length of the elongated member and horizontally in a direction substantially transverse to the length of the elongated member. In certain embodiments, the generally L-shaped members may be removably connected to the elongated member.

11 Claims, 5 Drawing Sheets

GOLF SWING AID

CROSS-REFERENCE TO RELATED APPLICATION

The present application claims the benefit under 35 U.S.C. § 119(e) of pending U.S. Provisional Patent Application Ser. No. 60/927,487 entitled "Barrel Golf Swing Aid" filed on May 3, 2007. The entirety of U.S. Provisional Application Serial No. 60/927,487 is incorporated herein by reference.

FIELD OF THE INVENTION

The present invention relates to apparatuses for improving an individual's swing and more particularly, to golf swing aids.

BACKGROUND OF THE INVENTION

Golf is a sport that requires a player to hit a ball to a target position using a golf club as a hitting tool. The golf club is swung by a golfer to hit a ball. The way a golfer swings his/her golf club directly affects how the club face strikes the ball at impact, and thus, where the golf ball is ultimately hit. Golfers often practice their golf swing to try and ensure that the mechanics of a golf swing that accurately and powerfully hit a golf ball are learned by the golfer and used by the golfer when playing golf. Such golf swing mechanics include a golfer's posture before hitting the ball and a golfer's moving posture when swinging a golf club to hit a golf ball. Such moving posture can include the posture of the golfer's body during back swing, down swing, impact and follow through portions of a golf swing. The goal is to train the muscles of the body to swing the same way each time.

It is often very difficult for golfers to learn how to perform a golf swing that permits the golfer to accurately and powerfully hit a golf ball. Generally, the continuous and rhythmical golf swing motion must be extensively practiced to master such a golf swing. In a proper golf swing a golfer initiates the swing by making a back swing. During the back swing, a golfer pivots his/her hips and rotates about his/her back leg until reaching the top of his/her back swing. The golfer then performs a down swing by swinging the golf club downward, preferably in an arc similar to that of the back swing The down swing is typically performed by transferring the golfer's weight from his/her back leg to his/her front leg while rotating his/her hips to generate club head speed. After the golf club has been swung downwards, the club impacts the golf ball. After impacting the golf ball, the golf club is swung through a follow-through motion while maintaining balance.

An error that often occurs in many golf swings is that the golfer slides his/her hips forward in a lateral direction that reduces the torque generated and, consequently, the power of the down swing. This sliding motion often results in inaccurately hitting the golf ball and or hitting the golf ball a short distance. A golfer may also improperly move his/her feet during the golf swing or improperly dip a shoulder during a portion of the golf swing. Of course, golfers may also have other problems mastering an effective golf swing, such a, for example, too much movement in the upper and/or lower portions of their body.

U.S. Pat. Nos. 5,830,079, 5,762,565, 5,591,090, 5,288,074, 3,698,721 and 3,215,438, disclose examples of golf swing aids that have been used to help a golfer learn a golf swing. Such golf swing aids typically focus on limiting hip sliding, head movement, or both, during practice swings to help a golfer learn a proper golf swing. Such golf swing aids typically fail to permit a golfer to focus on the movement of different parts of his/her body during his/her golf swing. For example, some golf swing aids are merely configured to prevent a golfer from improperly sliding his/her hips forwardly during the downward swing portion of a golf swing. Other golf swing aids are configured to only prevent a golfer from improperly moving his/her back leg during the back swing of the golfer's golf swing. Yet other golf swing aids are only configured to prevent a golfer from moving his/her head when making a golf swing.

Many golf swing aids are also not configured to permit a user to alter the configuration of the golf swing aid to focus on learning the proper motion for different body parts. For example, some golf swing aids are only configured to focus on hip movement during a golf swing and are not capable of being readjusted to focus on foot spacing during the stance of the swing or leg positioning and movement during portions of a golf swing.

There is a need for a golf swing aid that will teach a proper stance, proper hip movement, proper back and front leg movement, and the proper movement of other body parts that will help a golfer learn the proper movements of all portions of a golf swing. There is also a need for a golf swing aid that is capable of helping a golfer practice his/her golf swing to address different problems the golfer may be experiencing with different portions of his/her golf swing or the movement of different body parts during the different portions of his/her golf swing.

The present invention is directed towards overcoming one or more of the above-mentioned problems.

SUMMARY OF THE INVENTION

A golf swing aid is provided that includes a base, an elongated member and one or more generally L-shaped members. The elongated member is connected to the base and extends substantially vertically from the base. The one or more generally L-shaped members are moveably connected to the elongated member such that the one or more generally L-shaped members are positionable vertically along a length of the elongated member and horizontally in a direction substantially transverse to the length of the elongated member.

One embodiment of the swing aid may include two or more generally L-shaped members. Each generally L-shaped member is connected to the elongated member such that each generally L-shaped member is independently positionable vertically along a length of the elongated member and horizontally in a direction substantially transverse to the length of the elongated member.

In some embodiments, the one or more generally L-shaped members are slidable along at least a portion of the length of the elongated member. In other embodiments, the generally L-shaped member is removably connected to the elongated member.

Embodiments of the inventive golf swing aid may also include one or more connectors that connect the one or more generally L-shaped members to the elongated member. Preferably, at least one of the one or more connectors is a friction fit universal joint.

One embodiment of the one or more connectors can include a first mouth sized and configured to receive a portion of the one or more generally L-shaped members and a second mouth sized and configured to receive a portion of the elongated member. The first mouth faces a first direction and the second mouth faces a second direction opposite the first direction. The first mouth may be defined by generally a C-shaped member or a generally U-shaped member. The second mouth may also be defined by generally a C-shaped member or a generally U-shaped member.

In one embodiment of the inventive golf swing aid, the base may include a stake. In another embodiment, the base may include a stand that has two or more projections.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the invention are shown in the accompanying drawings and certain present preferred methods of practicing the same are also illustrated therein.

DETAILED DESCRIPTION OF PRESENT PREFERRED EMBODIMENTS

Figure 1:
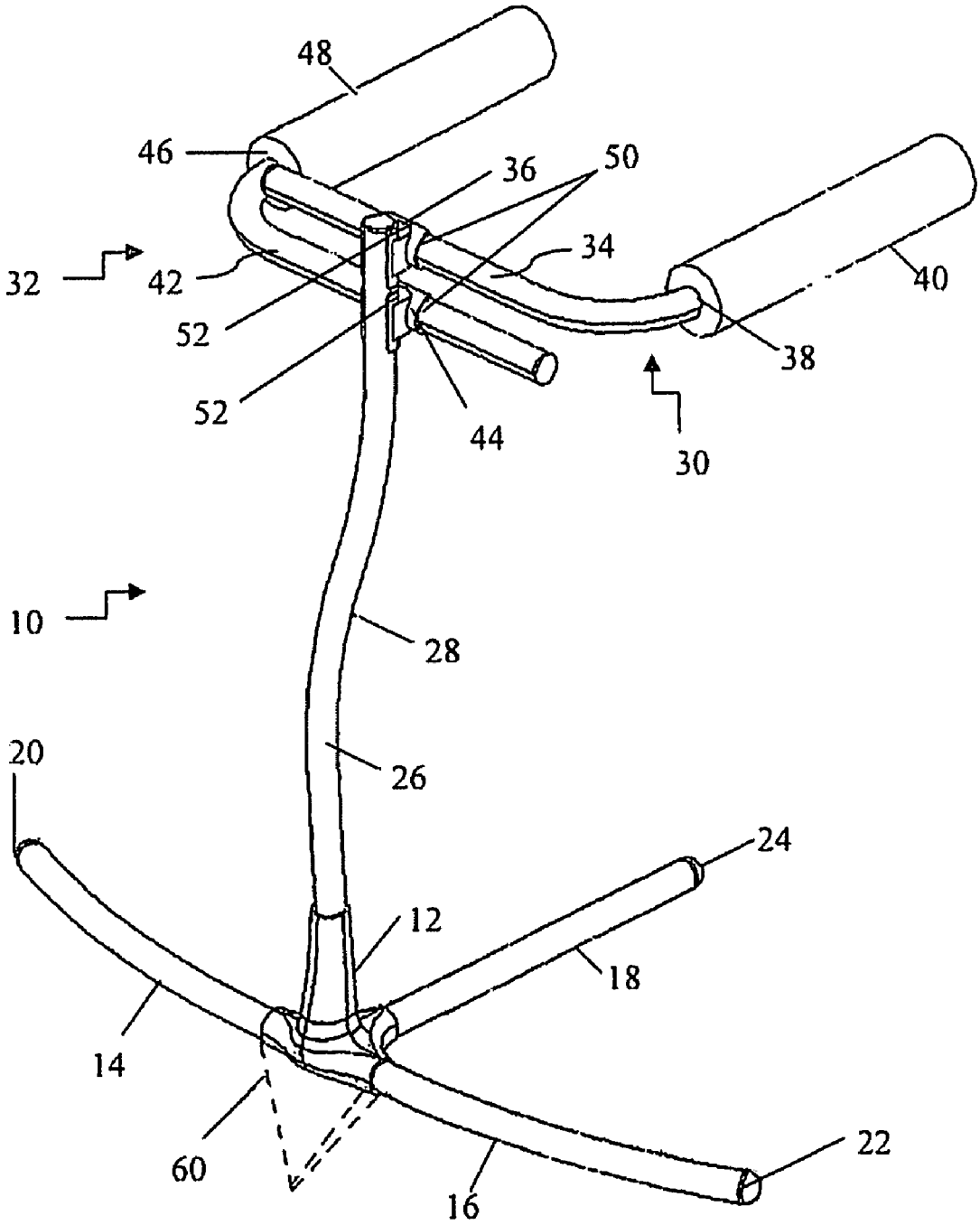
FIG. 1 is a perspective view of a first present preferred embodiment of the golf swing aid of the present invention with the generally L-shaped members in a first position along the length of the elongated member of the inventive golf swing aid.

A first present preferred embodiment of the inventive golf swing aid 10 is illustrated in FIGS. 1 through 5. The first present preferred embodiment of the swing aid 10 includes a base 12, which includes a stand that has three horizontally aligned receptacles sized and configured to receive an end of a respective projection configured to support the base 12 on a surface. Projections 14, 16 and 18, which in one form are tubular members, extend from the horizontally aligned receptacles in the base 12. The distal end of each projection 14, 16 and 18 has a weighted end cap 20, 22 and 24, respectively. Preferably, the weighted end caps 20, 22 and 24 are snap fit, friction fit, or adhesively connected to the ends of the projections 14, 16 and 18.

In alternative embodiments, the base 12 may include a stake 60, which is shown in dotted line in FIG. 1. The stake 60 may be inserted into the ground to support the golf swing aid 10 in an upright position.

The base 12 also has a vertically aligned receptacle that is sized and configured to receive an elongated member 26. The elongated member 26 has an end that is received within the vertically aligned receptacle of the base 12 and extends substantially vertically from the base 12. Preferably, the elongated member 26 has a curved contour such that the ends of the elongated member are positioned backward or forward relative to the middle portion 28 of the elongated member 26. Preferably, the elongated member 26 is tubular and made of plastic, such as, for example, polyvinyl chloride (PVC). Of course, the elongated member 26 may also be composed of other materials such as, for example, metal or composites. It should be appreciated that the elongated member 26 and projections 14, 16 and 18 can be rigid or stiff.

Figure 2:
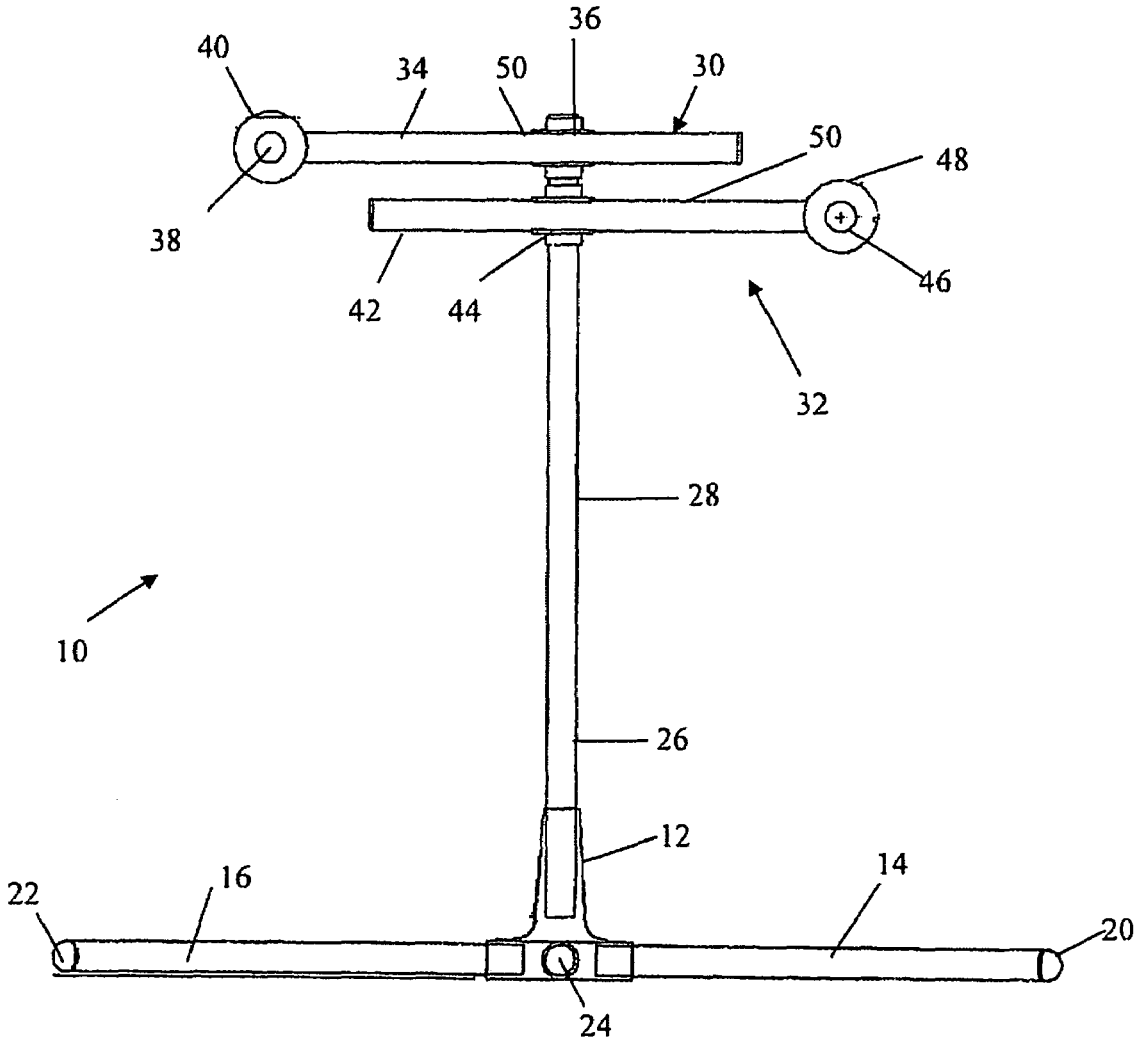
FIG. 2 is a front view of the first present preferred embodiment shown in FIG. 1.
Figure 3:
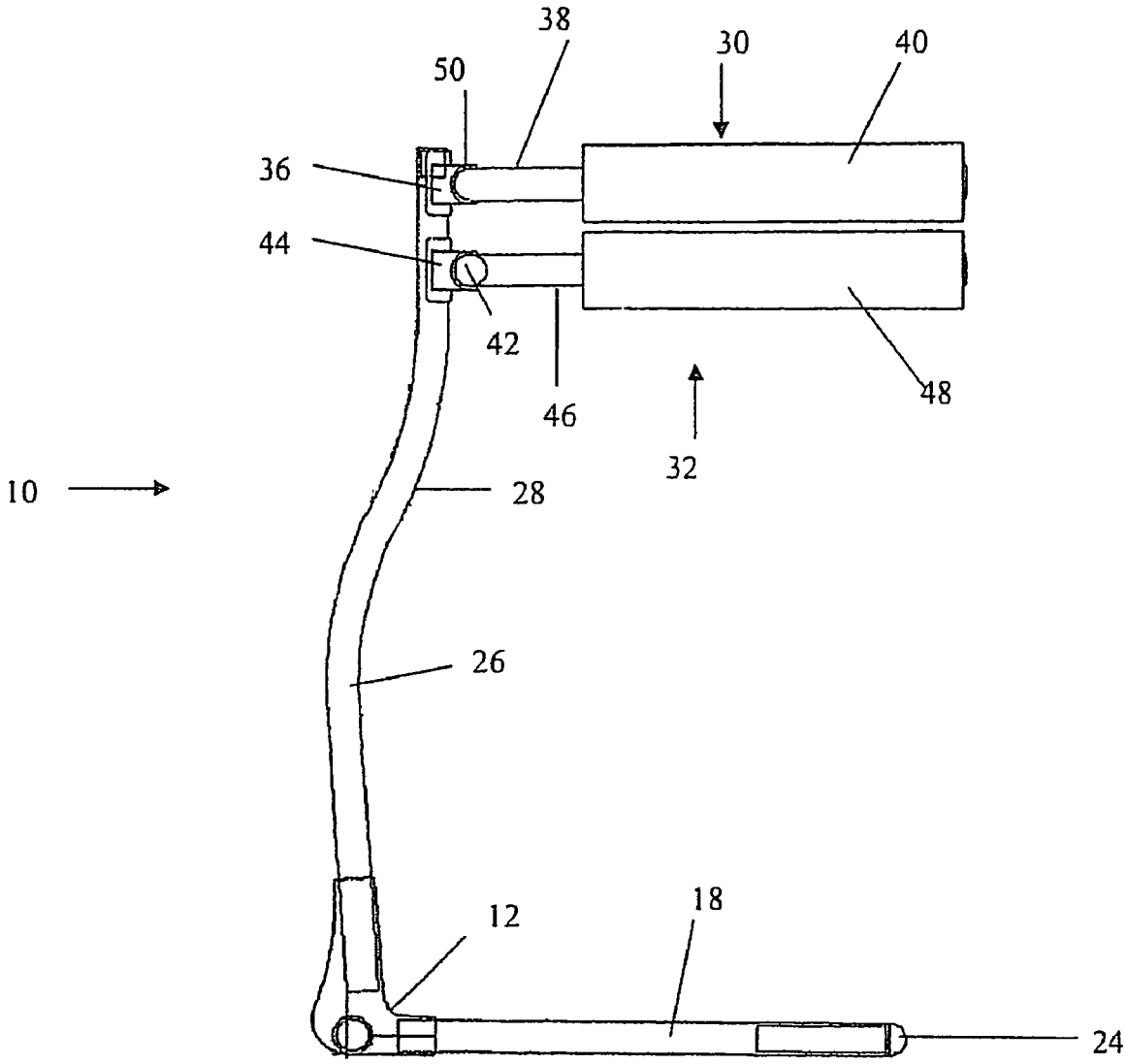
FIG. 3 is a side view of the first present preferred embodiment illustrated in FIG. 1.

One or more generally L-shaped members 30 and 32 are moveably connected to the elongated member 26 via a connector 36. Each generally L-shaped member may be a unitary structure that is curved or may have portions that are attached to each other at approximately a right angle to each other. As shown in FIGS. 1 through 3, a first generally L-shaped member 30 and second generally L-shaped member 32 are moveably connected to the elongated member 26. The first generally L-shaped member 30 is positioned above the second generally L shaped member 32.

The first generally L-shaped member 30 has a first portion 34 connected to the elongated member 26. The first portion 34 of the first generally L-shaped member 30 is generally transverse to the elongated member 26 and, in one form, is perpendicular to the elongated member 26. The first generally L-shaped member 30 also has a second portion 38 that extends at an angle from the first portion 34. In one form, this angle is approximately 90°. A pad 40 is attached to the second portion 38 of the first generally L-shaped member 30.

The second generally L-shaped member 32 also has a first portion 42 that is connected to the elongated member 26 via a connector 44. The first portion 42 of the second generally L-shaped member 32 is generally transverse to the elongated member 26 and, in one form, is perpendicular to the elongated member 26. The second generally L-shaped member 32 also has a second portion 46 that extends at an angle from the first portion 42. In one form, this angle is approximately 90°. A pad 48 is attached to the second portion 46 of the second generally L-shaped member 32.

The connectors 36 and 44 moveably connect the generally L-shaped members 30 and 32 to the elongated member 26 such the each generally L-shaped members 30 and 32 may independently move along at least a portion of the length of the elongated member 26. The first generally L-shaped member 30 is moveable along at least a portion of the length of the elongated member 26 independent of the second generally L-shaped member 32. The second generally L-shaped member 32 is also moveable along at least a portion of the length of the elongated member 26 independent of the first generally L-shaped member 30. Thus, each generally L-shaped member 30, 32 may be independently positioned to any spot along the length of the elongated member 26. While two generally L-shaped members are shown in the Figures, any number can be implemented without departing from the sprit and scope of the present invention.

Figure 4:
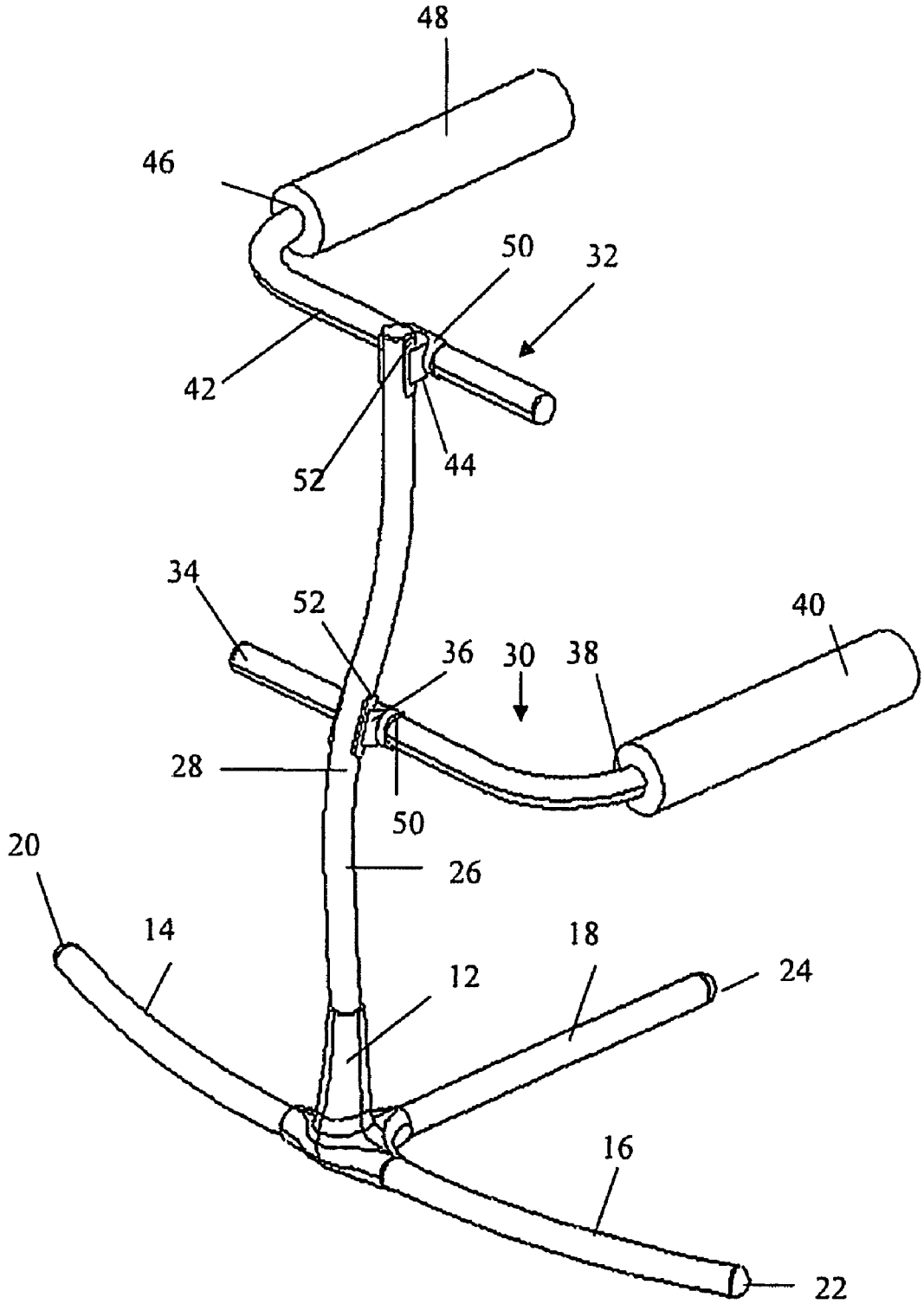
FIG. 4 is a perspective view of the first present preferred embodiment of the golf swing aid of the present invention with the generally L-shaped members in a second position along the length of the elongated member of the inventive golf swing aid.
Figure 5:
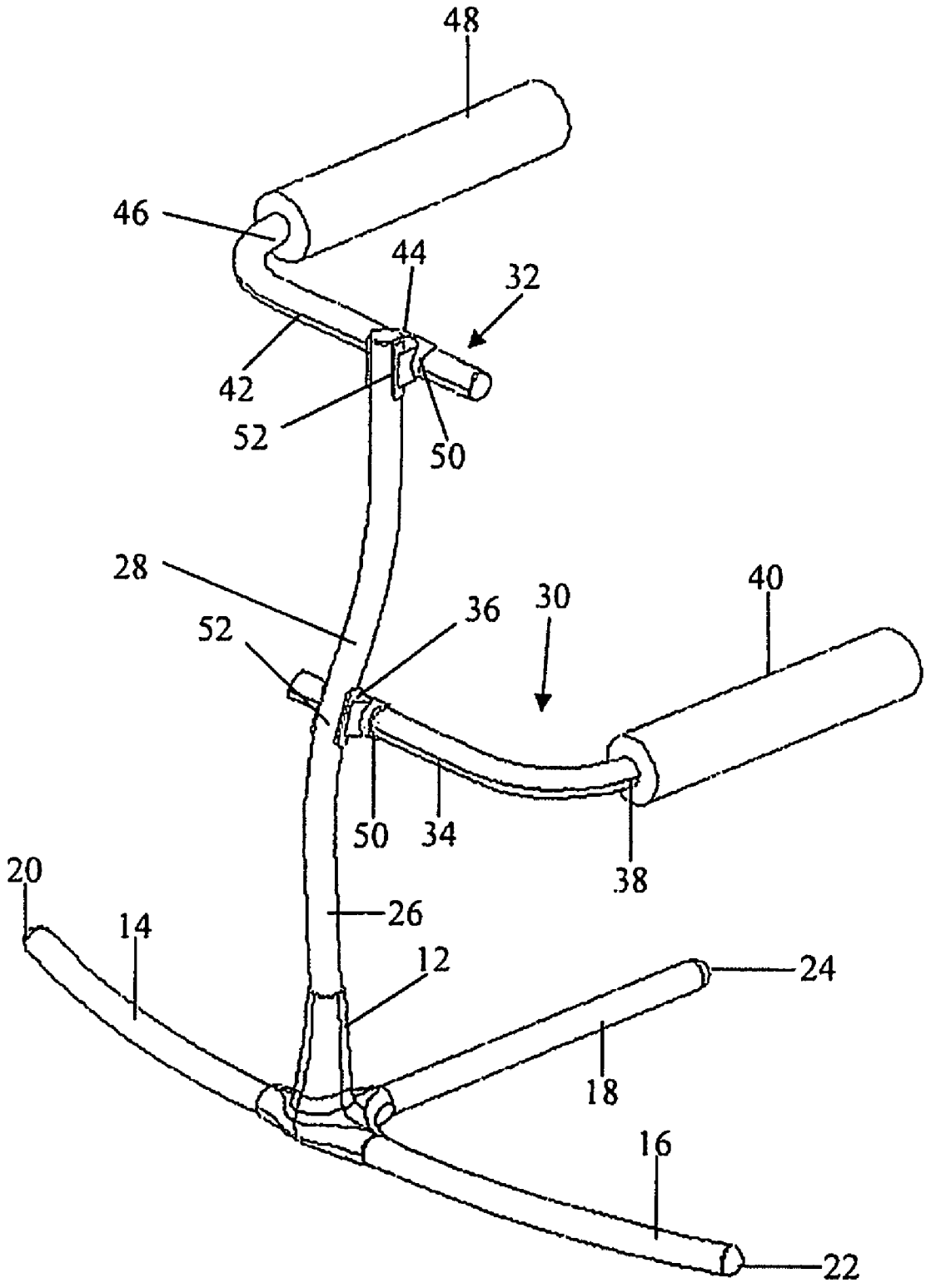
FIG. 5 is a perspective view similar to FIG. 4, illustrating the generally L-shaped members in a horizontally extended position.

The connectors 36 and 44 also removably connect the generally L-shaped members 30 and 32 such that either generally L-shaped member may be removed from the elongated member 26 and subsequently reconnected to the elongated member 26 at a different position. As illustrated in FIGS. 4 and 5, the first generally L-shaped member 30 can be repositioned from the configuration illustrated in FIGS. 1 through 3 so that it is below the second generally L-shaped member 32. Additionally, the connectors 36 and 44 removably connect the generally L-shaped members 30 and 32 such that the generally L-shaped members are repositionable in a horizontal direction to either increase or decrease the spacing therebetween.

Each connector 36, 44 includes a first mouth 50 and a second mouth 52 that faces a direction opposite the first mouth 50. The first mouth 50 is sized and configured to receive the second portion 34 or 42 of a generally L-shaped member 30, 32. The second mouth 52 is sized and configured to receive a portion of the elongated member 26. In certain embodiments, the first mouth 50 and second mouth 52 may be defined by U-shaped or C-shaped members. Preferably, the connectors 36, 44 are friction fit universal joints, which allow for virtually infinite repositioning of the generally L-shaped members 30, 32 along the length of the elongated member 26, as well as virtually infinite repositioning of the generally L-shaped members 30, 32 in a horizontal direction.

The first mouth 50 of the connectors 36, 44 can be configured to permit the first portion 34, 42 to slide through the first mouth 50 and be positioned at a virtually infinite number of positions. A user may adjust the distance the first portion 34, 42 (and ultimately the pads 40, 48) extends beyond the right or left side of the elongated member 26 by sliding the first portion 34 or 42 through the first mouth 50, as can be appreciated from FIGS. 4 and 5. Such movement can permit the generally L-shaped members 30, 32 to be adjusted to fit users of different widths or to be positioned for contacting different portions of a user's body. When a user wishes to adjust the horizontal alignment of the generally L-shaped members 30, 32, the user may push or pull the generally L-shaped members 30, 32 horizontally so that the first portions 34, 42 thereof slide through the first mouth 50 of the connectors 36, 44. A virtually infinite number of horizontal positioning is possible.

The second mouth 52 of each connector 36, 44 is configured to permit the generally L-shaped members 30, 32 to move along the length, or at least a portion of the length of the elongated member 26. Such movement may be, for example, by sliding the connectors 36, 44 along at least a portion of the length of the elongated member 26. It should be understood that the friction fit of the second mouth 52 to the elongated member 26 permits the connector 36, 44 to stay in a selected position unless a user manually moves the connector 36, 44 downward or upward along the elongated member 26.

Preferably, the generally L-shaped members 30, 32, elongated member 26, base 12, projections 14, 16 and 18 and connectors 36 and 44 are all composed of plastic such as, for example, polyvinyl chloride (PVC). However, each component can be made of different materials such as, for example, metals, composites or woods, etc.

The present invention contemplates any type of connection device or apparatus that will allow the generally L-shaped members to be independently repositionable both vertically along the length of the elongated member 26 and horizontally. For example, an embodiment could include connectors that include a sleeve moveably connected around and to the elongated member 26 so that it is moveable along the length of the elongated member 26. The sleeve can also include an additional sleeve configured to receive the first portion 34, 42 of a generally L-shaped members 30, 32. Such a connector could also include pins or other locking mechanisms such as, for example, screws, configured to pass through holes in the sleeves to contact the generally L-shaped members and/or the elongated member 26 to adjustably lock the position of the generally L-shaped members 30, 32. In other embodiments, the generally L-shaped members and/or elongated member could also have holes configured to align with the holes in the sleeves. A pin or screw may extend through the hole in the sleeves and through the hole in the generally L-shaped members and/or elongated member aligned with the hole. Nuts or bolts could also be included for positioning on a pin or screw to lock the position of the pin or screw and the position of the generally L-shaped member.

Another embodiment could include a ratchet type connection in which the elongated member 26 and first portions 34 and 42 include notches or indentations which engages a member in a corresponding connector. Disengagement of the member allows movement of the generally L-shaped members, either vertically or horizontally, while engagement of the member with a corresponding notch or indentation will hold the generally L-shaped member in place.

A user may use the golf swing aid 10 by positioning the first 30 and/or second 32 generally L-shaped members to help keep a particular body part in the proper posture or alignment during a golf swing. Importantly, a user may use the swing aid 10 by standing so that his/her chest faces toward the elongated member 26 or faces away from the elongated member 26. When a user is positioned so that the user faces the elongated member 26, the elongated member 26 is preferably shorter then the waist of the user and is configured to be between the user and the head of a golf club that may be swung by the golfer. As may best be appreciated in FIG. 3, a present preferred embodiment of the elongated member 26 is curved to more easily accommodate such use of embodiments of the swing aid. Of course, a user may also use the swing aid so that the user's back faces toward the elongated member. This is the preferred method of use.

When using the swing aid 10, the user may adjust the vertical position of the generally L-shaped members so that the generally L-shaped members contact or are just adjacent portions of the user's body when the user is aligned for swinging a golf club or otherwise positioned to practice a golf swing. The user may adjust any of the generally L-shaped members near the bottom of the elongated member 26 adjacent the feet or shins of the user when the user is in the proper golf swing stance. As another example, a user may also adjust the height of the generally L-shaped members adjacent the hips of a user during any or all portions of a golf swing. As yet another example, a user may locate one of the generally L-shaped members near where one of the user's feet or shins should be during his/her stance and another generally L-shaped member adjacent to where one of the user's hips or knees should be during his/her stance or during some portion of the user's golf swing. Of course, additional generally L-shaped members could also be positioned on the elongated member 26 adjacent to any portion of the user's body to assist the user in developing an improved golf swing. The user may then practice his/her golf swing so that his/her muscle memory can learn the proper positioning during the stance or other portions of the golf swing that the user wishes to focus on learning.

When in use, it is contemplated that the pads of the generally L-shaped members be positioned adjacent a portion of the user's body. Then, if during the golf swing, that portion of the user's body touches the pad, the user knows that his/her golf swing was improper. It is contemplated that the pads be approximately 3 inches away form a user's body, but any distance may be implemented and the pads may even engage the user if desired.

It should be appreciated that other variations of the present preferred embodiments discussed above may be made. For example, embodiments of the golf swing aid can include a base that includes more than three projections or only two projections. The base may be simply a weighted base, or a stake that can be inserted into the ground As another example, the components of the swing aid, such as, for example, the projections, elongated member or generally L-shaped members may have various different shapes. For example, one or more of the projections, elongated members or generally L-shaped members could be flat, have a square cross-section or have other non-tubular shapes or configurations. As yet another example, more than one pad may be attached to each generally L-shaped member. Of course, pads or cushions may also not be attached to each generally L-shaped member. As yet another example, only one generally L-shaped member may be connected to the elongated member 26 or more than two generally L-shaped members may be connected to the elongated member 26.

While certain present preferred embodiments of the golf swing aid and certain embodiments of methods of practicing the same have been shown and described, it is to be distinctly understood that the invention is not limited thereto but may be otherwise variously embodied and practiced within the scope of the following claims.

I claim:

1. A golf swing aid comprising:

a base;

a single elongated member connected to the base and extending substantially vertically from the base; and at least two generally L-shaped members, the at least two generally L-shaped members moveably connected to the single elongated member such that the at least two generally L-shaped members are positionable vertically along a length of the single elongated member and horizontally in a direction substantially transverse to the length of the single elongated member, such that the at least two generally L-shaped members are positionable adjacent each side of a user; and where in the at least two generally L-shaped members are independently positionable both vertically and horizontally.

2. The golf swing aid of claim 1 wherein the at least two generally L-shaped members are slidable along at least a portion of the length of the single elongated member.

3. The golf swing aid of claim 1 wherein the at least two generally L-shaped members are removably connected to the single elongated member.

4. The golf swing aid of claim 1 further comprising at least one pad attached to each of the generally L-shaped members.

5. The golf swing aid of claim 1 further comprising at least one connector that connects the at least two generally L-shaped members to the single elongated member.

6. The golf swing aid of claim 5 wherein the at least one connector is a friction fit universal joint.

7. The golf swing aid of claim 1 wherein the single elongated member is curved.

8. The golf swing aid of claim 1 further comprising at least two connectors, each connector connecting a respective generally L-shaped member to the single elongated member.

9. The golf swing aid of claim 8 wherein each connector is comprised of a body having a first mouth sized and configured to receive a portion of a respective generally L-shaped member, the first mouth facing a first direction and a second mouth sized and configured to receive a portion of the single elongated member, the second mouth facing a second direction that is opposite the first direction.

10. The golf swing aid of claim 9 wherein the first mouth is defined by one of a generally C-shaped member and a generally U-shaped member and the second mouth is defined by one of a generally C-shaped member and a generally U-shaped member.

11. The golf swing aid of claim 8 wherein at least two connectors are friction fit universal joints.

* * * * *